US008095359B2

(12) United States Patent
Boehm et al.

(10) Patent No.: US 8,095,359 B2
(45) Date of Patent: Jan. 10, 2012

(54) METHOD AND APPARATUS FOR ENCODING AND DECODING AN AUDIO SIGNAL USING ADAPTIVELY SWITCHED TEMPORAL RESOLUTION IN THE SPECTRAL DOMAIN

(75) Inventors: Johannes Boehm, Goettingen (DE); Sven Kordon, Hannover (DE)

(73) Assignee: Thomson Licensing, Princeton, NJ (US)

( * ) Notice: Subject to any disclaimer, the term of this patent is extended or adjusted under 35 U.S.C. 154(b) by 889 days.

(21) Appl. No.: 12/156,748

(22) Filed: Jun. 4, 2008

(65) Prior Publication Data

US 2009/0012797 A1 Jan. 8, 2009

(30) Foreign Application Priority Data

Jun. 14, 2007 (EP) ..... 07110289

(51) Int. Cl.
*G10L 19/02* (2006.01)

(52) U.S. Cl. ..... 704/203; 704/205; 704/269

(58) Field of Classification Search ..... None
See application file for complete search history.

(56) References Cited

U.S. PATENT DOCUMENTS

| | | | | |
|---|---|---|---|---|
| 5,566,154 | A * | 10/1996 | Suzuki | 369/59.26 |
| 6,029,126 | A * | 2/2000 | Malvar | 704/204 |
| 6,058,362 | A * | 5/2000 | Malvar | 704/230 |
| 6,115,689 | A * | 9/2000 | Malvar | 704/503 |
| 6,182,034 | B1 * | 1/2001 | Malvar | 704/230 |
| 6,240,380 | B1 * | 5/2001 | Malvar | 704/204 |
| 6,253,165 | B1 * | 6/2001 | Malvar | 703/2 |
| 6,256,608 | B1 * | 7/2001 | Malvar | 704/230 |
| 7,275,031 | B2 * | 9/2007 | Hoerich et al. | 704/230 |
| 7,516,064 | B2 * | 4/2009 | Vinton et al. | 704/206 |
| 7,516,074 | B2 * | 4/2009 | Bilobrov | 704/270 |
| 7,630,902 | B2 * | 12/2009 | You | 704/500 |
| 2004/0181403 | A1 | 9/2004 | Hsu | |
| 2005/0143979 | A1 | 6/2005 | Lee et al. | |

(Continued)

OTHER PUBLICATIONS

Niamut O. A. et al. "Flexible frequency decompositions for cosine-modulated filter banks", 2003 IEEE International Conference on Acoustics, Speech, and Signal Processing, Proceedings. (ICASSP). Hong Kong, Apr. 6-10, 2003, IEEE International Conference on Acoustics, Speech and Signal Processing (ICASSP), New York, NY IEEE, US, vol. 1 of 6, Apr. 6, 2003 pp. 449-V452 XPO10639305.

(Continued)

*Primary Examiner* — Talivaldis Ivars Smits
(74) *Attorney, Agent, or Firm* — International IP Law Group, P.C.

(57) ABSTRACT

Perceptual audio codecs make use of filter banks and MDCT in order to achieve a compact representation of the audio signal, by removing redundancy and irrelevancy from the original audio signal. During quasi-stationary parts of the audio signal a high frequency resolution of the filter bank is advantageous in order to achieve a high coding gain, but this high frequency resolution is coupled to a coarse temporal resolution that becomes a problem during transient signal parts by producing audible pre-echo effects. The invention achieves improved coding/decoding quality by applying on top of the output of a first filter bank a second non-uniform filter bank, i.e. a cascaded MDCT. The inventive codec uses switching to an additional extension filter bank (or multi-resolution filter bank) in order to re-group the time-frequency representation during transient or fast changing audio signal sections. By applying a corresponding switching control, pre-echo effects are avoided and a high coding gain and a low coding delay are achieved.

17 Claims, 4 Drawing Sheets

U.S. PATENT DOCUMENTS

| | | | | |
|---|---|---|---|---|
| 2007/0016405 | A1 | 1/2007 | Mehrotra et al. | |
| 2007/0100610 | A1* | 5/2007 | Disch et al. | 704/212 |
| 2008/0027729 | A1* | 1/2008 | Herre et al. | 704/273 |
| 2009/0018824 | A1* | 1/2009 | Teo | 704/203 |

OTHER PUBLICATIONS

European Search Report dated Oct. 8, 2007.

* cited by examiner

METHOD AND APPARATUS FOR ENCODING AND DECODING AN AUDIO SIGNAL USING ADAPTIVELY SWITCHED TEMPORAL RESOLUTION IN THE SPECTRAL DOMAIN

FIELD OF THE INVENTION

This application claims the benefit, under 35 U.S.C. §119 of European Patent Application 07110289.1, filed Jun. 14, 2007.

The invention relates to a method and to an apparatus for encoding and decoding an audio signal using transform coding and adaptive switching of the temporal resolution in the spectral domain.

BACKGROUND OF THE INVENTION

Perceptual audio codecs make use of filter banks and MDCT (modified discrete cosine transform, a forward transform) in order to achieve a compact representation of the audio signal, i.e. a redundancy reduction, and to be able to reduce irrelevancy from the original audio signal. During quasi-stationary parts of the audio signal a high frequency or spectral resolution of the filter bank is advantageous in order to achieve a high coding gain, but this high frequency resolution is coupled to a coarse temporal resolution that becomes a problem during transient signal parts. A well-know consequence are audible pre-echo effects.

B. Edler, "Codierung von Audiosignalen mit ütberlappender Transformation und adaptiven Fensterfunktionen", Frequenz, Vol. 43, No. 9, p. 252-256, September 1989, discloses adaptive window switching in the time domain and/or transform length switching, which is a switching between two resolutions by alternatively using two window functions with different length.

U.S. Pat. No. 6,029,126 describes a long transform, whereby the temporal resolution is increased by combining spectral bands using a matrix multiplication. Switching between different fixed resolutions is carried out in order to avoid window switching in the time domain. This can be used to create non-uniform filter-banks having two different resolutions.

WO-A-03/019532 discloses sub-band merging in cosine modulated filter-banks, which is a very complex way of filter design suited for poly-phase filter bank construction.

SUMMARY OF THE INVENTION

The above-mentioned window and/or transform length switching disclosed by Edler is sub-optimum because of long delay due to long look-ahead and low frequency resolution of short blocks, which prevents providing a sufficient resolution for optimum irrelevancy reduction.

A problem to be solved by the invention is to provide an improved coding/decoding gain by applying a high frequency resolution as well as high temporal resolution for transient audio signal parts.

The invention achieves improved coding/decoding quality by applying on top of the output of a first filter bank a second non-uniform filter bank, i.e. a cascaded MDCT. The inventive codec uses switching to an additional extension filter bank (or multi-resolution filter bank) in order to re-group the time-frequency representation during transient or fast changing audio signal sections.

By applying a corresponding switching control, pre-echo effects are avoided and a high coding gain is achieved. Advantageously, the inventive codec has a low coding delay (no look-ahead).

In principle, the inventive encoding method is suited for encoding an input signal, e.g. an audio signal, using a first forward transform into the frequency domain being applied to first-length sections of said input signal, and using adaptive switching of the temporal resolution, followed by quantization and entropy encoding of the values of the resulting frequency domain bins, wherein control of said switching, quantization and/or entropy encoding is derived from a psycho-acoustic analysis of said input signal, including the steps of:

- adaptively controlling said temporal resolution is achieved by performing a second forward transform following said first forward transform and being applied to second-length sections of said transformed first-length sections, wherein said second length is smaller than said first length and either the output values of said first forward transform or the output values of said second forward transform are processed in said quantization and entropy encoding;
- attaching to the encoding output signal corresponding temporal resolution control information as side information.

In principle the inventive encoding apparatus is suited for encoding an input signal, e.g. an audio signal, said apparatus including:

- first forward transform means being adapted for transforming first-length sections of said input signal into the frequency domain;
- second forward transform means being adapted for transforming second-length sections of said transformed first-length sections, wherein said second length is smaller than said first length;
- means being adapted for quantizing and entropy encoding the output values of said first forward transform means or the output values of said second forward transform means;
- means being adapted for controlling said quantization and/or entropy encoding and for controlling adaptively whether said output values of said first forward transform means or the output values of said second forward transform means are processed in said quantizing and entropy encoding means, wherein said controlling is derived from a psycho-acoustic analysis of said input signal;
- means being adapted for attaching to the encoding apparatus output signal corresponding temporal resolution control information as side information.

In principle, the inventive decoding method is suited for decoding an encoded signal, e.g. an audio signal, that was encoded using a first forward transform into the frequency domain being applied to first-length sections of said input signal, wherein the temporal resolution was adaptively switched by performing a second forward transform following said first forward transform and being applied to second-length sections of said transformed first-length sections, wherein said second length is smaller than said first length and either the output values of said first forward transform or the output values of said second forward transform were processed in a quantization and entropy encoding, and wherein control of said switching, quantization and/or entropy encoding was derived from a psycho-acoustic analysis of said input signal and corresponding temporal resolution control information was attached to the encoding output signal as side information, said decoding method including the steps of:

- providing from said encoded signal said side information;
- inversely quantizing and entropy decoding said encoded signal;

corresponding to said side information, either performing a first forward inverse transform into the time domain, said first forward inverse transform operating on first-length signal sections of said inversely quantized and entropy decoded signal and said first forward inverse transform providing the decoded signal, or processing second-length sections of said inversely quantized and entropy decoded signal in a second forward inverse transform before performing said first forward inverse transform.

In principle, the inventive decoding apparatus is suited for decoding an encoded signal, e.g. an audio signal, that was encoded using a first forward transform into the frequency domain being applied to first-length sections of said input signal, wherein the temporal resolution was adaptively switched by performing a second forward transform following said first forward transform and being applied to second-length sections of said transformed first-length sections, wherein said second length is smaller than said first length and either the output values of said first forward transform or the output values of said second forward transform were processed in a quantization and entropy encoding, and wherein control of said switching, quantization and/or entropy encoding was derived from a psycho-acoustic analysis of said input signal and corresponding temporal resolution control information was attached to the encoding output signal as side information, said apparatus including:

means being adapted for providing from said side information and for inversely quantizing and entropy decoding said encoded signal;

means being adapted for, corresponding to said side information, either performing a first forward inverse transform into the time domain, said first forward inverse trans-form operating on first-length signal sections of said inversely quantized and entropy decoded signal and said first forward inverse transform providing the decoded signal, or processing second-length sections of said inversely quantized and entropy decoded signal in a second forward inverse transform before performing said first forward inverse transform.

BRIEF DESCRIPTION OF THE DRAWINGS

Exemplary embodiments of the invention are described with reference to the accompanying drawings, which show in.

DETAILED DESCRIPTION OF PREFERRED EMBODIMENTS

Figure 1:
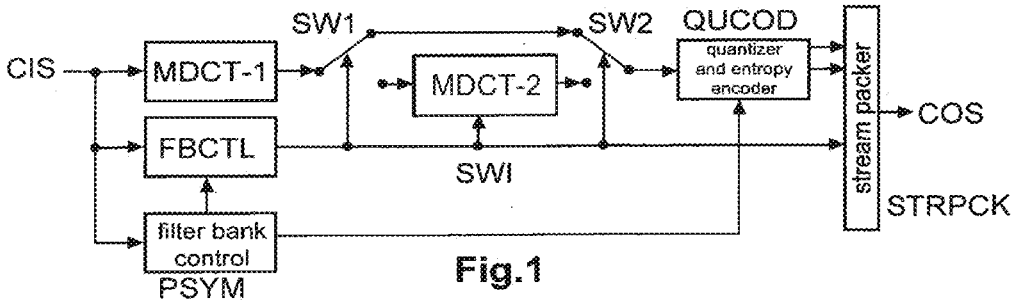
FIG. 1 inventive encoder.

In FIG. 1, the magnitude values of each successive overlapping block or segment or section of samples of a coder input audio signal CIS are weighted by a window function and transformed in a long (i.e. a high frequency resolution) MDCT filter bank or transform stage or step MDCT-1, providing corresponding transform coefficients or frequency bins. During transient audio signal sections a second MDCT filter bank or transform stage or step MDCT-2, either with shorter fixed transform length or preferably a multi-resolution MDCT filter bank having different shorter transform lengths, is applied to the frequency bins of the first forward transform (i.e. on the same block) in order to change the frequency and temporal filter resolutions, i.e. a series of non-uniform MDCTs is applied to the frequency data, whereby a non-uniform time/frequency representation is generated. The amplitude values of each successive overlapping section of frequency bins of the first forward transform are weighted by a window function prior to the second-stage transform. The window functions used for the weighting are explained in connection with FIGS. 4 to 7 and equations (3) and (4). In case of MDCT or integer MDCT transforms, the sections are 50% overlapping. In case a different transform is used the degree of overlapping can be different.

In case only two different transform lengths are used for stage or step MDCT-2, that step or stage when considered alone is similar to the above-mentioned Edler codec.

The switching on or off of the second MDCT filter bank MDCT-2 can be performed using first and second switches SW1 and SW2 and is controlled by a filter bank control unit or step FBCTL that is integrated into, or is operating in parallel to, a psycho-acoustic analyzer stage or step PSYM, which both receive signal CIS. Stage or step PSYM uses temporal and spectral information from the input signal CIS. The topology or status of the 2nd stage filter MDCT-2 is coded as side information into the coder output bit stream COS. The frequency data output from switch SW2 is quantized and entropy encoded in a quantiser and entropy encoding stage or step QUCOD that is controlled by psycho-acoustic analyzer PSYM, in particular the quantization step sizes. The output from stages QUCOD (encoded frequency bins) and FBCTL (topology or status information or temporal resolution control information or switching information SW1 or side information) is combined in a stream packer step or stage STRPCK and forms the output bit stream COS.

The quantizing can be replaced by inserting a distortion signal.

Figure 2:
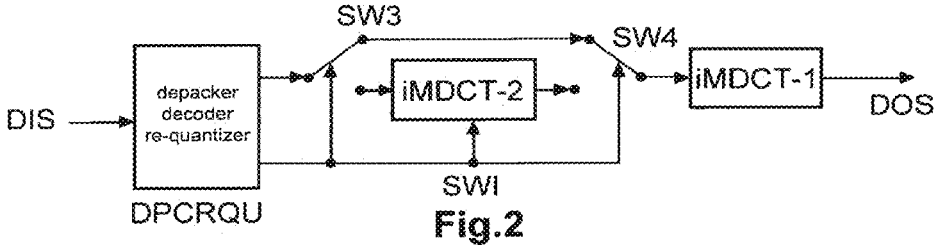
FIG. 2 inventive decoder.

In FIG. 2, at decoder side, the decoder input bit stream DIS is de-packed and correspondingly decoded and inversely 'quantized' (or re-quantized) in a depacking, decoding and re-quantizing stage or step DPCRQU, which provides correspondingly decoded frequency bins and switching information SW1. A correspondingly inverse non-uniform MDCT step or stage iMDCT-2 is applied to these decoded frequency bins using e.g. switches SW3 and SW4, if so signaled by the bit stream via switching information SW1. The amplitude values of each successive section of inversely transformed values are weighted by a window function following the transform in step or stage iMDCT-2, which weighting is followed by an overlap-add processing. The signal is reconstructed by applying either to the decoded frequency bins or to the output of step or stage iMDCT-2 a correspondingly inverse high-resolution MDCT step or stage iMDCT-1 . The amplitude values of each successive section of inversely transformed values are weighted by a window function following the transform in step or stage iMDCT-1, which weighting is followed by an overlap-add processing. Thereafter, the PCM audio decoder output signal DOS. The transform lengths applied at decoding side mirror the corresponding transport lengths applied at encoding side, i.e. the same block of received values is inverse transformed twice.

The window functions used for the weighting are explained in connection with FIGS. 4 to 7 and equations (3) and (4). In case of inverse MDCT or inverse integer MDCT transforms, the sections are 50% overlapping. In case a different inverse transform is used the degree of overlapping can be different.

Figure 3:
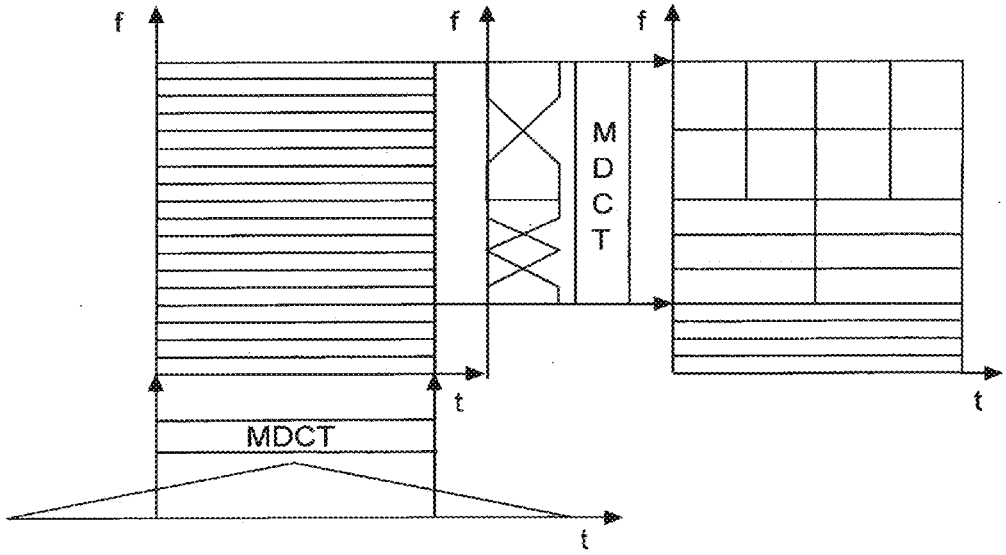
FIG. 3 a block of audio samples that is windowed and trans-formed with a long MDCT, and series of non-uniform MDCTs applied to the frequency data.

FIG. 3 depicts the above-mentioned processing, i.e. applying first and second stage filter banks. On the left side a block of time domain samples is windowed and transformed in a long MDCT to the frequency domain. During transient audio signal sections a series of non-uniform MDCTs is applied to the frequency data to generate a non-uniform time/frequency representation shown at the right side of FIG. 3. The time/frequency representations are displayed in grey or hatched.

The time/frequency representation (on the left side) of the first stage transform or filter bank MDCT-1 offers a high frequency or spectral resolution that is optimum for encoding stationary signal sections. Filter banks MDCT-1 and iMDCT-1 represent a constant-size MDCT and iMDCT pair with 50% overlapping blocks. Overlay-and-add (OLA) is used in filter bank iMDCT-1 to cancel the time domain alias. Therefore the filter bank pair MDCT-1 and iMDCT-1 is capable of theoretical perfect reconstruction.

Fast changing signal sections, especially transient signals, are better represented in time/frequency with resolutions matching the human perception or representing a maximum signal compaction tuned to time/frequency. This is achieved by applying the second transform filter bank MDCT-2 onto a block of selected frequency bins of the first forward transform filter bank MDCT-1.

The second forward transform is characterized by using 50% overlapping windows of different sizes, using transition window functions (i.e. 'Edler window functions' each of which having asymmetric slopes) when switching from one size to another, as shown in the medium section of FIG. 3. Window sizes start from length 4 to length $2^n$, wherein n is an integer number greater 2. A window size of '4' combines two frequency bins and doubled time resolution, a window size of $2^n$ combines $2^{(n-1)}$ frequency bins and increases the temporal resolution by factor $2^{(n-1)}$. Special start and stop window functions (transition windows) are used at the beginning and at the end of the series of MDCTs. At decoding side, filter bank iMDCT-2 applies the inverse transform including OLA. Thereby the filter bank pair MDCT-2/iMDCT-2 is capable of theoretical perfect reconstruction.

The output data of filter bank MDCT-2 is combined with single-resolution bins of filter bank MDCT-1 which were not included when applying filter bank MDCT-2.

The output of each transform or MDCT of filter bank MDCT-2 can be interpreted as time-reversed temporal samples of the combined frequency bins of the first forward transform. Advantageously, a construction of a non-uniform time/frequency representation as depicted at the right side of FIG. 3 now becomes feasible.

The filter bank control unit or step FBCTL performs a signal analysis of the actual processing block using time data and excitation patterns from the psycho-acoustic model in psycho-acoustic analyzer stage or step PSYM. In a simplified embodiment it switches during transient signal sections to fixed-filter topologies of filter bank MDCT-2, which filter bank may make use of a time/frequency resolution of human perception. Advantageously, only few bits of side information are required for signaling to the decoding side, as a code-book entry, the desired topology of filter bank iMDCT-2.

In a more complex embodiment, the filter bank control unit or step FBCTL evaluates the spectral and temporal flatness of input signal CIS and determines a flexible filter topology of filter bank MDCT-2 . In this embodiment it is sufficient to transmit to the decoder the coded starting locations of the start window, transition window and stop window positions in order to enable the construction of filter bank iMDCT-2.

The psycho-acoustic model makes use of the high spectral resolution equivalent to the resolution of filter bank MDCT-1 and, at the same time, of a coarse spectral but high temporal resolution signal analysis. This second resolution can match the coarsest frequency resolution of filter bank MDCT-2.

As an alternative, the psycho-acoustic model can also be driven directly by the output of filter bank MDCT-1, and during transient signal sections by the time/frequency representation as depicted at the right side of FIG. 3 following applying filter bank MDCT-2.

In the following, a more detailed system description is provided.

The MDCT

The Modified Discrete Cosine Transformation (MDCT) and the inverse MDCT (iMDCT) can be considered as representing a critically sampled filter bank. The MDCT was first named "Oddly-stacked time domain alias cancellation transform" by J. P. Princen and A. B. Bradley in "Analysis/synthesis filter bank design based on time domain aliasing cancellation", IEEE Transactions on Acoust. Speech Sig. Proc. ASSP-34 (5), pp. 1153-1161, 1986.

H. S. Malvar, "Signal processing with lapped transform", Artech House Inc., Norwood, 1992, and M. Temerinac, B. Edler, "A unified approach to lapped orthogonal transforms", IEEE Transactions on Image Processing, Vol. 1, No. 1, pp. 111-116, January 1992, have called it "Modulated Lapped Trans-form (MLT)" and have shown its relations to lapped orthogonal transforms in general and have also proved it to be a special case of a QMF filter bank.

The equations of the transform and the inverse transform are given in equations (1) and (2):

$$X(k) = \sqrt{\frac{2}{N}} \sum_{n=0}^{N-1} h(n) \cdot x(n) \cdot \cos\left[\frac{\pi}{K} \cdot \left(n + \frac{K+1}{2}\right) \cdot \left(k + \frac{1}{2}\right)\right], \quad k = 0, 1 \ldots, K-1; K = N/2 \tag{1}$$

$$x(n) = \sqrt{\frac{2}{N}} \sum_{k=0}^{K-1} h(n) \cdot X(k) \cdot \cos\left[\frac{\pi}{K} \cdot \left(n + \frac{K+1}{2}\right) \cdot \left(k + \frac{1}{2}\right)\right], \quad n = 0, 1 \ldots, N-1 \tag{2}$$

In these transforms, 50% overlaying blocks are processed. At encoding side, in each case, a block of N samples is windowed and the magnitude values are weighted by window function h(n) and is thereafter transformed to K=N/2 frequency bins, wherein N is an integer number. At decoding side, the inverse transform converts in each case M frequency bins to N time samples and thereafter the magnitude values are weighted by window function h(n), wherein N and M are integer numbers. A following overlay-add procedure cancels out the time alias. The window function h(n) must fulfill some constraints to enable perfect reconstruction, see equations (3) and (4):

$$h^2(n+N/2)+h^2(n)=1 \tag{3}$$

$$h(n)=h(N-n-1) \tag{4}$$

Analysis and synthesis window functions can also be different but the inverse transform lengths used in the decoding correspond to the transform lengths used in the encoding.

However, this option is not considered here. A suitable window function is the sine window function given in (5):

$$h_{\sin}(n) = \sin\left(\pi \cdot \frac{n+0.5}{N}\right), n = 0 \ldots N-1 \quad (5)$$

In the above-mentioned article, Edler has shown switching the MDCT time-frequency resolution using transition windows.

Figure 4:
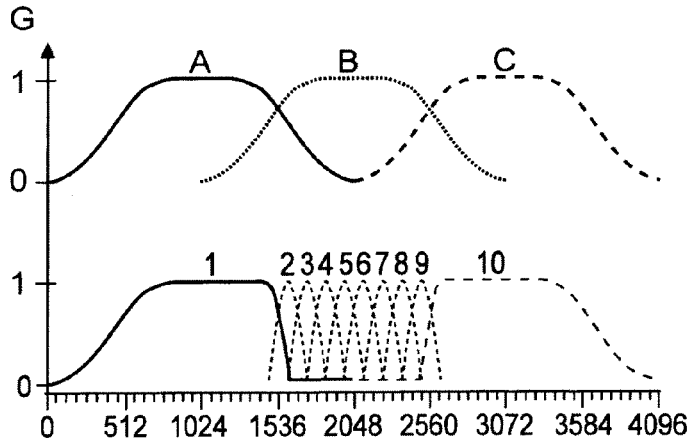
FIG. 4 changing the time-frequency resolution by changing the block length of the MDCT.
Figure 5:
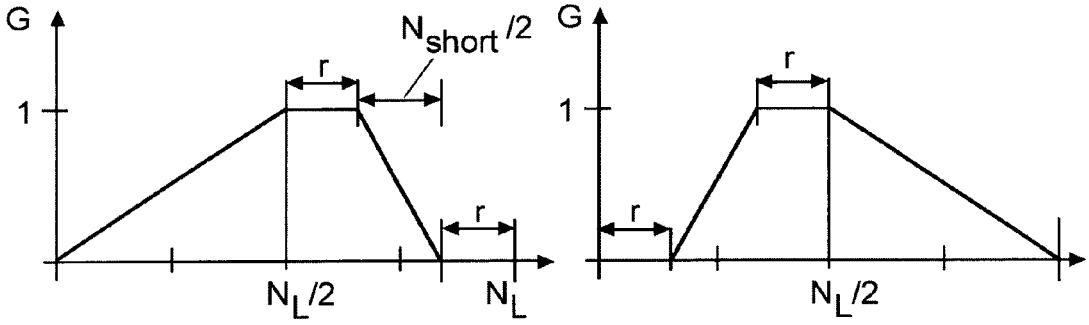
FIG. 5 transition windows.

An example of switching (caused by transient conditions) using transition windows 1, 10 from a long transform to eight short transforms is depicted in the bottom part of FIG. 4, which shows the gain G of the window functions in vertical direction and the time, i.e. the input signal samples, in horizontal direction. In the upper part of this figure three successive basic window functions A, B and C as applied in steady state conditions are shown.

The transition window functions have the length $N_L$ Of the long transform. At the smaller-window side end there are r zero-amplitude window function samples. Towards the window function centre located at $N_L/2$, a mirrored half-window function for the small transform (having a length of $N_{short}$ samples) is following, further followed by r window function samples having a value of 'one' (or a 'unity' constant). The principle is depicted for a transition to short window at the left side of FIG. 5 and for a transition from short window at the right side of FIG. 5. Value r is given by $$r=(N_L-N_{short})/4 \quad (6)$$

Multi-Resolution Filter Bank

The first-stage filter bank MDCT-1, iMDCT-1 is a high resolution MDCT filter bank having a sub-band filter bandwidth of e.g. 15-25 Hz. For audio sampling rates of e.g. 32-48 kHz a typical length of $N_L$ is 2048 samples. The window function h(n) satisfies equations (3) and (4). Following application of filter MDCT-1 there are 1024 frequency bins in the preferred embodiment. For stationary input signal sections, these bins are quantized according to psycho-acoustic considerations.

Fast changing, transient input signal sections are processed by the additional MDCT applied to the bins of the first MDCT. This additional step or stage merges two, four, eight, sixteen or more sub-bands and thereby increases the temporal resolution, as depicted in the right part of FIG. 3.

Figure 6:
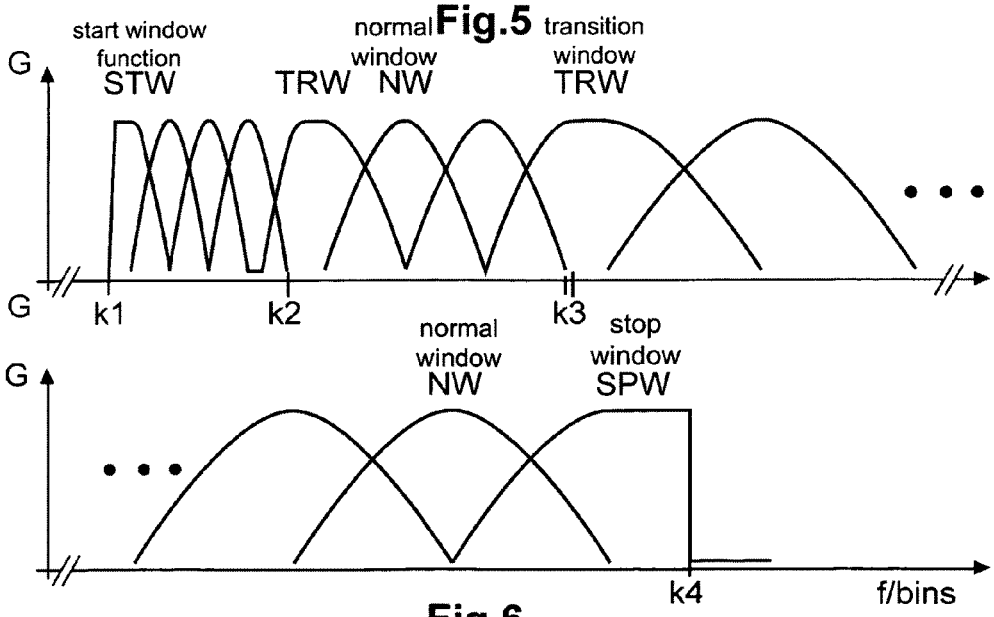
FIG. 6 window sequence example for second-stage MDCTs.
Figure 7:
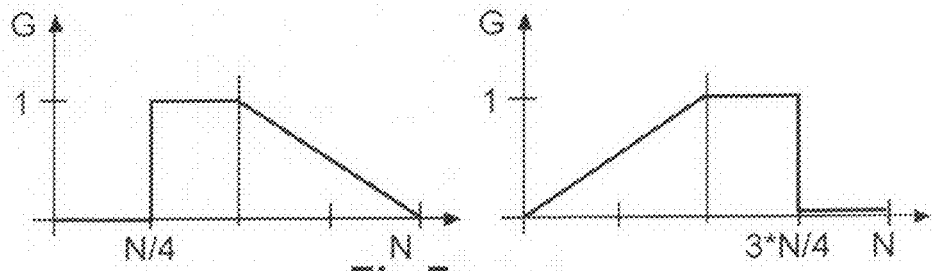
FIG. 7 start and stop windows for first and last MDCT.

FIG. 6 shows an example sequence of applied windowing for the second-stage MDCTs within the frequency domain. Therefore the horizontal axis is related to f/bins. The transition window functions are designed according to FIG. 5 and equation (6), like in the time domain. Special start window functions STW and stop window functions SPW handle the start and end sections of the transformed signal, i.e. the first and the last MDCT. The design principle of these start and stop window functions is shown in FIG. 7. One half of these window functions mirrors a half-window function of a normal or regular window function NW, e.g. a sine window function according to equation (5). Of other half of these window functions, the adjacent half has a continuous gain of 'one' (or a 'unity' constant) and the other half has the gain zero.

Figure 8:
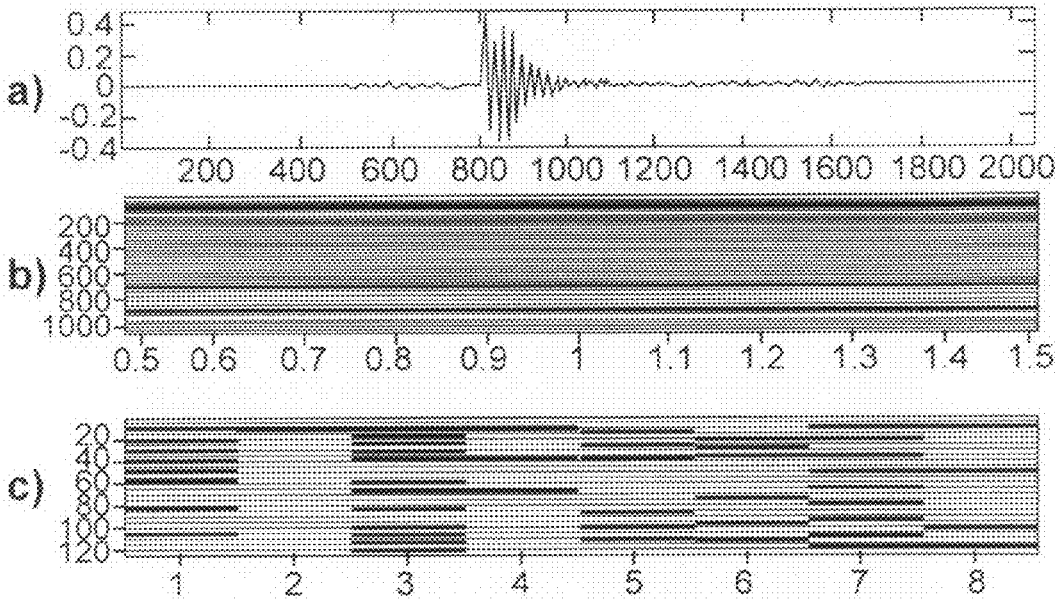
FIG. 8 time domain signal of a transient, T/F plot of first MDCT stage and T/F plot of second-stage MDCTs with an 8-fold temporal resolution topology.
Figure 9:
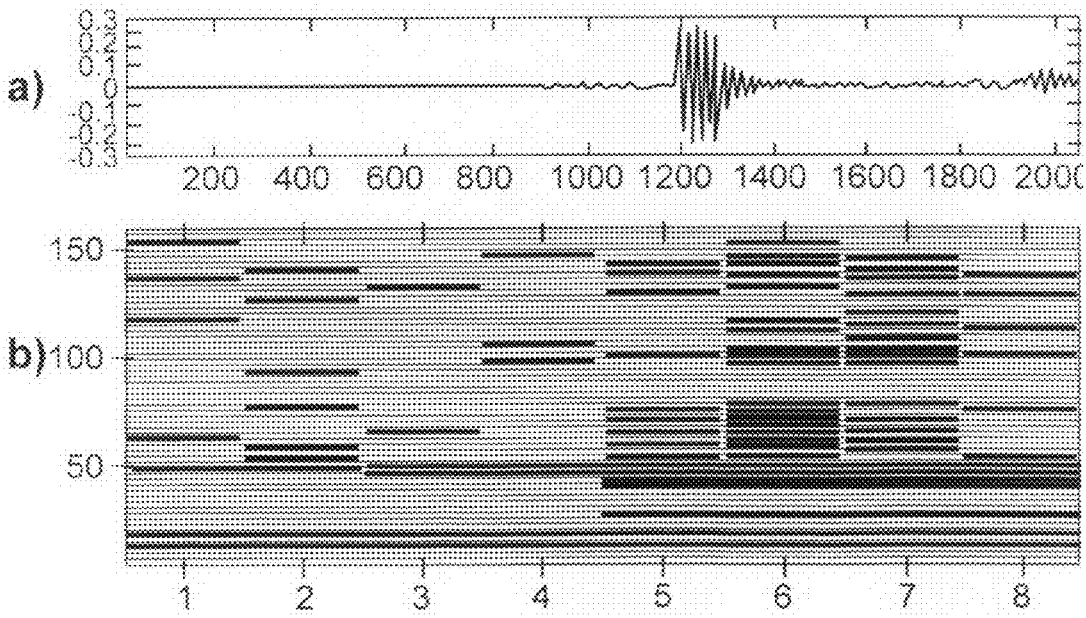
FIG. 9 time domain signal of a transient, second-stage filter bank T/F plot of a single, 2-fold, 4-fold and 8-fold temporal resolution topology.

Due to the properties of MDCT, performing MDCT-2 can also be regarded as a partial inverse transformation. When applying the forward MDCTs of the second stage MDCTs, each one of such new MDCT (MDCT-2) can be regarded as a new frequency line (bin) that has combined the original windowed bins, and the time reversed output of that new MDCT can be regarded as the new temporal blocks. The presentation in FIGS. 8 and 9 is based on this assumption or condition.

Indices ki in FIG. 6 indicate the regions of changing temporal resolution. Frequency bins starting from position zero up to position k1−1 are copied from (i.e. represent) the first forward transform (MDCT-1), which corresponds to a single temporal resolution.

Bins from index k1−1 to index k2 are transformed to g1 frequency lines. g1 is equal to the number of transforms performed (that number corresponds to the number of overlapping windows and can be considered as the number of frequency bins in the second or upper transform level MDCT-2). The start index is bin k1−1 because index k1 is selected as the second sample in the first forward transform in FIG. 6 (the first sample has a zero amplitude, see also FIG. 10*a*). g1=(number_of_windowed_bins)/(N/2)−1=(k2−k1+1)/2−1, with a regular window size N of e.g. 4 bins, which size creates a section with doubled temporal resolution.

Bins from index k2−3 to index k3+4 are combined to g2 frequency lines (transforms), i.e. g2=(k3−k2+2)/4−1. The regular window size is e.g. 8 bins, which size results in a section with quadrupled temporal resolution.

The next section in FIG. 6 is transformed by windows (trans-form length) spanning e.g. 16 bins, which size results in sections having eightfold temporal resolution. Windowing starts at bin k3−5. If this is the last resolution selected (as is true for FIG. 6), then it ends at bin k4+4, otherwise at bin k4.

Where the order (i.e. the length) of the second-stage transform is variable over successive transform blocks, starting from frequency bins corresponding to low frequency lines, the first second-stage MDCTs will start with a small order and the following second-stage MDCTs will have a higher order. Transition windows fulfilling the characteristics for perfect reconstruction are used.

Figure 10:
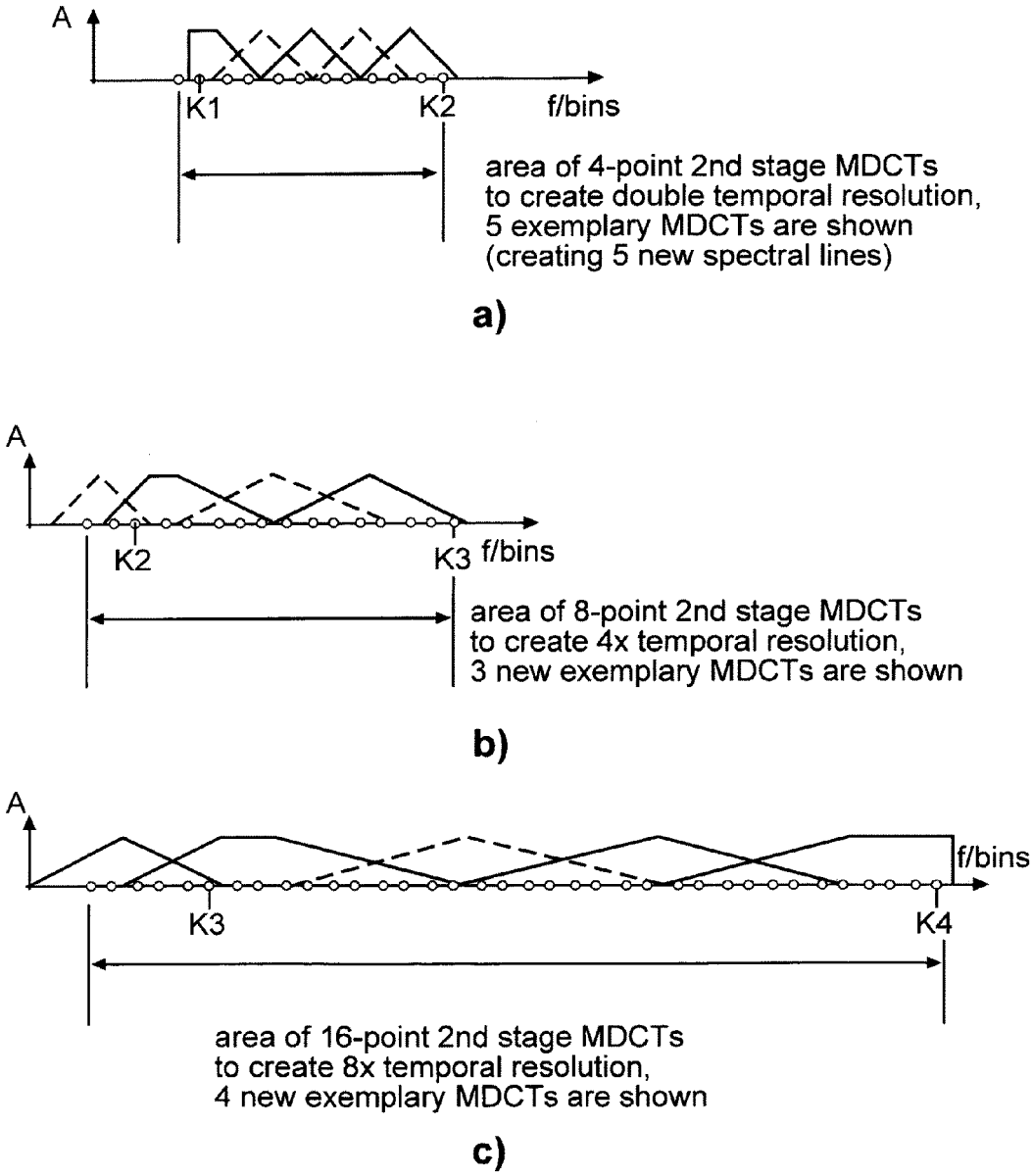
FIG. 10 more detail for the window processing according to FIG. 6.

The processing according to FIG. 6 is further explained in FIG. 10, which shows a sample-accurate assignment of frequency indices that mark areas of a second (i.e. cascaded) transform (MDCT-2), which second transform achieves a better temporal resolution. The circles represent bin positions, i.e. frequency lines of the first or initial transform (MDCT-1).

FIG. 10*a* shows the area of 4-point second-stage MDCTs that are used to provide doubled temporal resolution. The five MDCT sections depicted create five new spectral lines. FIG. 10*b* shows the area of 8-point second-stage MDCTs that are used to provide fourfold temporal resolution. Three MDCT sections are depicted. FIG. 10*c* shows the area of 16-point second-stage MDCTs that are used to provide eightfold temporal resolution. Four MDCT sections are depicted.

At decoder side, stationary signals are restored using filter bank iMDCT-1, the iMDCT of the long transform blocks including the overlay-add procedure (OLA) to cancel the time alias.

When so signaled in the bitstream, the decoding or the decoder, respectively, switches to the multi-resolution filter bank iMDCT-2 by applying a sequence of iMDCTs according to the signaled topology (including OLA) before applying filter bank iMDCT-1.

Signaling the Filter Bank Topology to the Decoder

The simplest embodiment makes use of a single fixed topology for filter bank MDCT-2/iMDCT-2 and signals this with a single bit in the transferred bitstream. In case more fixed sets of topologies are used, a corresponding number of bits is used for signaling the currently used one of the topologies. More advanced embodiments pick the best out of a set of fixed code-book topologies and signal a corresponding code-book entry inside the bitstream.

In embodiments were the filter topology of the second-stage transforms is not fixed, a corresponding side information is transmitted in the encoding output bitstream. Preferably, indices k1, k2, k3, k4, . . . , kend are transmitted.

Starting with quadrupled resolution, k2 is transmitted with the same value as in k1 equal to bin zero. In topologies ending with temporal resolutions coarser than the maximum temporal resolution, the value transmitted in kend is copied to k4, k3, . . . .

The following table illustrates this with some examples. bi is a place holder for a frequency bin as a value.

| | Indices signaling topology | | | | |
|---|---|---|---|---|---|
| Topology | k1 | k2 | k3 | k4 | kend |
| Topology with 1x, 2x, 4x, 8x, 16x temporal resolutions | b1 > 1 | b2 | b3 | b4 | b5 |
| Topology with 1x, 2x, 4x, 8x temporal resolutions (like in FIG. 6) | b1 > 1 | b2 | b3 | b4 | b4 |
| Topology with 8x temporal resolution only | 0 | 0 | 0 | bmax | bmax |
| Topology with 4x, 8x and 16x temporal resolution | 0 | 0 | b2 | b3 | bmax |

Due to temporal psycho-acoustic properties of the human auditory system it is sufficient to restrict this to topologies with temporal resolution increasing with frequency.

Filter Bank Control

The simplest embodiment can use any state-of-the-art transient detector to switch to a fixed topology matching, or for coming close to, the T/F resolution of human perception. The preferred embodiment uses a more advanced control processing:

- Calculate a spectral flatness measure SFM, e.g. according to equation (7), over selected bands of M frequency lines ($f_{bin}$) of the power spectral density Pm by using a discrete Fourier transform (DFT) of a windowed signal of a long transform block with $N_L$ samples, i.e. the length of MDCT-1 (the selected bands are proportional to critical bands);
- Divide the analysis block of $N_L$ samples into S>8 overlapping blocks and apply S windowed DFTs on the sub-blocks. Arrange the result as a matrix having S columns (temporal resolution, $t_{block}$) and a number of rows according the number of frequency lines of each DFT, S being an integer;
- Calculate S spectrograms Ps, e.g. general power spectral densities or psycho-acoustically shaped spectrograms (or excitation patterns);
- For each frequency line determine a temporal flatness measure (TFM) according to equation (8);
- Use the SFM vector to determine tonal or noisy bands, and use the TFM vector to recognize the temporal variations within this bands. Use threshold values to decide whether or not to switch to the multi-resolution filter bank and what topology to pick.

$$SFM = \text{arithmetic mean value } [fbin] / \text{geometric mean value } [fbin] = \frac{1}{M} \cdot \sum_m Pm \Big/ \left(\prod_M Pm\right)^{\frac{1}{M}} \tag{7}$$

$$TFM = \text{arithmetic mean value } [\text{tblock}] / \text{geometric mean value } [\text{tblock}] = \frac{1}{S} \cdot \sum_s Ps \Big/ \left(\prod_S Ps\right)^{\frac{1}{S}} \tag{8}$$

Filter Bank Topology Examples

FIGS. 8 and 9 depict two examples of multi-resolution T/F (time/frequency) energy plots of a second-stage filter bank. FIG. 8 shows an '8× temporal resolution only' topology. A time domain signal transient in FIG. 8*a* is depicted as amplitude over time (time expressed in samples). FIG. 8*b* shows the corresponding T/F energy plot of the first-stage MDCT (frequency in bins over normalized time corresponding to one transform block), and FIG. 8*c* shows the corresponding T/F plot of the second-stage MDCTs (8*128 time-frequency tiles). FIG. 9 shows a '1×, 2×, 4×, 8× topology'. A time domain signal transient in FIG. 9*a* is depicted as amplitude over time (time expressed in samples). FIG. 9*b* shows the corresponding T/F plot of the second-stage MDCTs, whereby the frequency resolution for the lower band part is selected proportional to the bandwidths of perception of the human auditory system (critical bands), with bN1=16, bN2=16, bN4=16, bN8=114, for 1024 coefficients in total (these numbers have the following meaning: 16 frequency lines having single temporal resolution, 16 frequency lines having double, 16 frequency lines having 4 times, and 114 frequency lines having 8 times temporal resolution). For the low frequencies there is a single partition, followed by two and four partitions and, above about f=50, eight partitions.

In a different embodiment, the topology is determined by the following steps:

- performing a spectral flatness measure SFM using said first forward transform, by determining for selected frequency bands the spectral power of transform bins and dividing the arithmetic mean value of said spectral power values by their geometric mean value;
- sub-segmenting an un-weighted input signal section, performing weighting and short transforms on m sub-sections where the frequency resolution of these transforms corresponds to said selected frequency bands;
- for each frequency line consisting of m transform segments, determining the spectral power and calculating a temporal flatness measure TFM by determining the arithmetic mean divided by the geometric mean of the m segments;
- determining tonal or noisy bands by using the SFM values;
- using the TFM values for recognizing the temporal variations in these bands. Threshold values are used for switching to finer temporal resolution for said indicated noisy frequency bands.

The MDCT can be replaced by a DCT, in particular a DCT-4. Instead of applying the invention to audio signals, it also be applied in a corresponding way to video signals, in which case the psycho-acoustic analyzer PSYM is replaced by an analyzer taking into account the human visual system properties.

The invention can be use in a watermark embedder. The advantage of embedding digital watermark information into an audio or video signal using the inventive multi-resolution filter bank, when compared to a direct embedding, is an increased robustness of watermark information transmission and watermark information detection at receiver side. In one embodiment of the invention the cascaded filter bank is used with a audio watermarking system. In the watermarking encoder a first (integer) MDCT is performed. A first watermark is inserted into bins 0 to k1−1 using a psycho-acoustic controlled embedding process. The purpose of this watermark can be frame synchronization at the watermark decoder. Second-stage variable size (integer) MDCTs are applied to bins starting from bin index k1 as described before. The output of this second stage is resorted to gain a time-frequency expression by interpreting the output as time-reversed temporal blocks and each second-stage MDCT as a new frequency line (bin). A second watermark signal is added onto each one of these new frequency lines by using an attenuation factor that is controlled by psycho-acoustic considerations. The data is resorted and the inverse (integer) MDCT (related to the above-mentioned second-stage MDCT) is performed as described for the above embodiments (decoder), including windowing and overlay/add. The full spectrum related to the first forward transform is restored. The full-size inverse (integer) MDCT performed onto that data, windowing and overlay/add restores a time signal with a watermark embedded.

The multi-resolution filter bank is also used within the watermark decoder. Here the topology of the second-stage MDCTs is fixed by the application.

What is claimed is:

1. A method for encoding an input signal comprising:

transforming the input signal into a frequency domain via a first forward transform, wherein:

the first forward transform applied to first-length sections of the input signal and, using adaptive switching of a temporal resolution, is followed by quantization and entropy encoding of values of the resulting frequency domain bins;

the first forward transform and a second forward transform are a MDCT transform, an integer MDCT transform, a DCT-4 transform, or a DCT transform;

adaptively controlling the temporal resolution by performing a second forward transform following the first forward transform, wherein:

the second forward transform is applied to second-length sections of the transformed first-length sections; and the second-length sections are smaller than the first-length sections and either output values of the first forward transform or output values of the second forward transform are processed in the quantization and entropy encoding;

prior to the transforms at encoding side, the amplitude values of the first-length sections and the second-length sections are weighted using window functions, and overlap-add processing for the first-length sections and second-length sections is applied, and wherein for transitional windows the amplitude values are weighted using asymmetric window functions, and wherein for the second-length sections start and stop window functions are used; and control of the switching, quantization and/or entropy encoding is derived from a psychoacoustic analysis of the input signal; and attaching to an encoded output signal corresponding temporal resolution control information as side information.

2. The method according to claim 1, wherein if more than one different second length is used for signaling topology of different second lengths applied, indices indicating a region of changing temporal resolution, or an index number referring to a matching entry of a corresponding code book accessible at decoding side, are contained in the side information.

3. The method according to claim 2, wherein the topology is determined by:

performing a spectral flatness measure (SFM) using the first forward transform, by determining for selected frequency bands a spectral power value of transform bins and dividing an arithmetic mean value of the spectral power values by their geometric mean value;

sub-segmenting an un-weighted input signal section, performing weighting and short transforms on m sub-sections where a frequency resolution of the short transforms corresponds to the selected frequency bands;

for each frequency line consisting of m transform segments, determining the spectral power value and calculating a temporal flatness measure (TFM) by determining an arithmetic mean divided by a geometric mean of the m transform segments;

determining tonal or noisy frequency bands by using the SFM; and using the TFM for recognizing temporal variations in the tonal or noisy frequency bands and using threshold values for switching to finer temporal resolution for the determined noisy frequency bands.

4. The method according to claim 1, wherein if more than one different second length is used successively, lengths increase starting from frequency bins representing low frequency lines.

5. Use of the method according to claim 1 in a watermark embedder.

6. A method for decoding an encoded original signal, that was encoded into a frequency domain using a first forward transform that was applied to first-length sections of the original signal, wherein the first forward transform and a second forward transform are a MDCT transform, an integer MDCT transform, a DCT-4 transform, or a DCT transform, and wherein a temporal resolution was adaptively switched by performing the second forward transform following the first forward transform on second-length sections of the transformed first-length sections, wherein the second-length sections are smaller than the first-length sections and either output values of the first forward transform or output values of the second forward transform were processed in a quantization and entropy encoding, and wherein control of the switching, quantization and/or entropy encoding was derived from a psycho-acoustic analysis of the original signal and corresponding temporal resolution control information was attached to the encoding output signal as side information, the decoding method comprising:

providing from the encoded signal the side information;

inversely quantizing and entropy decoding the encoded signal; and corresponding to the side information, either:

performing a first inverse transform into a time domain, the first inverse transform operating on first-length signal sections of the inversely quantized and entropy decoded signal and the first inverse transform providing the decoded signal; or processing second-length sections of the inversely quantized and entropy decoded signal in a second inverse transform before performing the first inverse transform wherein, following the first inverse transform and the second inverse transform, the amplitude values of the first-length sections and the second-length sections are weighted using window functions, and overlap-add processing for the first-length sections and second-length sections is applied, and wherein for transitional windows the amplitude values are weighted using asymmetric window functions, and wherein for the second-length sections start and stop window functions are used, wherein the first inverse transform and the second inverse transform are an inverse MDCT, an inverse integer MDCT, or an inverse DCT-4 transform.

7. The method according to claim 6, wherein if more than one different second length is used for signaling a topology of different second lengths applied, indices indicating a region of changing temporal resolution, or an index number referring to a matching entry of a corresponding code book accessible at decoding side, are contained in the side information.

8. The method according to claim 7, wherein the topology is determined by:

performing a spectral flatness measure (SFM) using the first forward transform, by determining for selected frequency bands a spectral power value of transform bins and dividing an arithmetic mean value of the spectral power values by their geometric mean value;

sub-segmenting an un-weighted input signal section, performing weighting and short transforms on m sub-sections where a frequency resolution of the short transforms corresponds to the selected frequency bands;

for each frequency line consisting of m transform segments, determining the spectral power value and calculating a temporal flatness measure (TFM) by determining the arithmetic mean value divided by a geometric mean of the m transform segments;

determining tonal or noisy frequency bands by using the SFM; and using the TFM for recognizing temporal variations in the tonal or noisy frequency bands and using threshold values for switching to finer temporal resolution for the determined noisy frequency bands.

9. The method according to claim 6, wherein if more than one different second length is used successively, lengths increase starting from frequency bins representing low frequency lines.

10. An apparatus for encoding an input signal comprising:

first forward transform means being adapted for transforming first-length sections of the input signal into a frequency domain;

second forward transform means being adapted for transforming second-length sections of the transformed first-length sections, wherein the second-length sections are smaller than the first-length sections, wherein the first forward transform and the second forward transform are a MDCT transform, an integer MDCT transform, a DCT-4 transform, or a DCT transform;

means being adapted for quantizing and entropy encoding output values of the first forward transform means or output values of the second forward transform means;

means being adapted for controlling the quantization and/or entropy encoding and for controlling adaptively whether the output values of the first forward transform means or the output values of the second forward transform means are processed in the quantizing and entropy encoding means, wherein the controlling is derived from a psycho-acoustic analysis of the input signal; and means being adapted for attaching to an encoded apparatus output signal corresponding temporal resolution control information as side information, wherein, prior to the transforms at encoding side, amplitude values of the first-length sections and the second-length sections are weighted using window functions, and overlap-add processing for the first-length sections and the second-length sections is applied, and wherein for transitional windows the amplitude values are weighted using asymmetric window functions, and wherein for the second-length sections start and stop window functions are used.

11. The apparatus according to claim 10, wherein if more than one different second length is used for signaling a topology of different second lengths applied, several indices indicating a region of changing temporal resolution, or an index number referring to a matching entry of a corresponding code book accessible at decoding side, are contained in the side information.

12. The apparatus according to claim 11, wherein the topology is determined by:

performing a spectral flatness measure SFM using the first forward transfrom, by determing for selected frequency bands a spectral power value of transform bins and dividing an arithmetic mean value of the spectral power values by their geometric mean value;

sub-segmenting an un-weighted input signal section, performing weighting and short transforms on m sub-sections where a frequency resolution of the short transforms corresponds to the selected frequency bands;

for each frequency line consisting of m transfrom segments, determining the spectral power value and calculating a temporal flatness measure (TFM) by determining the arithmetic mean value divided by a geometric mean value of the m transform segments;

determining tonal or noisy frequency bands by using the SFM; and using the TFM for recognizing temporal variations in the tonal or noisy frequency bands and using threshold values for switching to finer temporal resolution for the determined noisy frequency bands.

13. The apparatus according to claim 10, wherein in case more than one different second length is used successively, lengths increase starting from frequency bins representing low frequency lines.

14. An apparatus for decoding an encoded original signal, that was encoded into a frequency domain using a first forward transform being applied to first-length sections of the original signal, wherein a temporal resolution was adaptively switched by performing a second forward transform following the first forward transform and being applied to second-length sections of the transformed first-length sections, wherein the first forward transform and the second forward transform are a MDCT transform, an integer MDCT transform, a DCT-4 transform, or a DCT transform, and wherein the second-length sections are smaller than the first-length sections and either output values of the first forward transform or output values of the second forward transform were processed in a quantization and entropy encoding, and wherein control of the switching, quantization and/or entropy encoding was derived from a psycho-acoustic analysis of the original signal and corresponding temporal resolution control information was attached to an encoded output signal as side information, the apparatus comprising:

means being adapted for providing from the encoded signal the side information and for inversely quantizing and entropy decoding the encoded signal; and means being adapted for, corresponding to the side information, either:

performing a first inverse transform into a time domain, the first inverse transform operating on first-length signal sections of the inversely quantized and entropy decoded signal and the first inverse transform providing a decoded signal; or processing second-length sections of the inversely quantized and entropy decoded signal in a second inverse transform before performing the first inverse transform, wherein, following the first inverse transform and the second inverse transform, amplitude values of the first-length sections and the second-length sections are weighted using window functions, and overlap-add processing for the first-length sections and second-length sections is applied, and wherein for transitional windows the amplitude values are weighted using asymmetric window functions, and wherein for the second-length sections start and stop window functions are used.

15. The apparatus according to claim 14, wherein if more than one different second length is used for signaling the topology of different second lengths applied, several indices indicating the region of changing temporal resolution, or an index number referring to a matching entry of a corresponding code book accessible at decoding side, are contained in the side information.

16. The apparatus according to claim 15, wherein the topology is determined by:

performing a spectral flatness measure (SFM) using the first forward transform, by determining for selected frequency bands a spectral power value of transform bins and dividing an arithmetic mean value of the spectral power values by their geometric mean value;

sub-segmenting an un-weighted input signal section, performing weighting and short transforms on m sub-sections where a frequency resolution of these transforms corresponds to the selected frequency bands;

for each frequency line consisting of m transform segments, determining the spectral power value and calculating a temporal flatness measure (TFM) by determining the arithmetic mean divided by a geometric mean of the m transform segments;

determining tonal or noisy frequency bands by using the SFM; and using the TFM for recognizing the temporal variations in the tonal or noisy frequency bands and using threshold values for switching to finer temporal resolution for the determined noisy frequency bands.

17. The apparatus according to claim 14, wherein in case more than one different second length is used successively, lengths increase starting from frequency bins representing low frequency lines.

* * * * *